US005333600A

United States Patent [19]

Fitzpatrick

[11] Patent Number: 5,333,600

[45] Date of Patent: Aug. 2, 1994

[54] PORTABLE TAR MELTING KETTLE ASSEMBLY

[76] Inventor: Martin Fitzpatrick, 12652 Bethel Rd., Martville, N.Y. 13111

[21] Appl. No.: 153,027

[22] Filed: Nov. 17, 1993

[51] Int. Cl.[5] ..... E01C 19/45; F24H 1/00

[52] U.S. Cl. ..... 126/343.5 A; 126/391; 432/160

[58] Field of Search ..... 126/343.5 R, 343.5 R, 126/391, 360 R, 373, 345, 349; 432/160, 157

[56] References Cited

U.S. PATENT DOCUMENTS

| | | | |
|---|---|---|---|
| 1,106,042 | 8/1914 | Gumm | 126/391 |
| 1,630,309 | 5/1927 | Pitman | 126/391 |
| 3,995,616 | 12/1976 | Schrader | 126/343.5 A |
| 4,033,328 | 7/1977 | Lohman et al. | 126/343.5 A |
| 4,416,614 | 11/1983 | Moody | 126/343.5 A |
| 4,418,681 | 12/1983 | Moody | 126/343.5 A |
| 4,905,663 | 3/1990 | Magee | 126/343.5 A |

*Primary Examiner*—James C. Yeung
*Attorney, Agent, or Firm*—Harris Beach & Wilcok

[57] ABSTRACT

A tar melting assembly that is used with a portable heat torch and has a tar melting kettle that includes a body having a front, back, side and bottom walls, and a spout that extends out from the front. A plurality of heat exchangers within the body are situated adjacent the bottom wall and each of these has an opening at the front and another opening at the back. A handle facilitates tipping of the kettle for pouring the melted tar. A stand for the tar kettle has a tray formed of a bottom, front, back and side walls that define the interior of the tray. The corners of the tray are supported on legs. A socket in the back wall of the tray receives the torch head and has a releasable latching provision. The tar kettle is seated in the stand so that inlets and outlets of the heat exchanger tubes are within the interior of the stand. The torch injects flame into the interior of the tray so that the flame enters the heat exchanger tubes for rapid melting of the tar in the tar kettle. A step plate is affixed onto the rear legs so that the operator can step on the plate to stable the assembly during pouring of the melted tar.

7 Claims, 2 Drawing Sheets

PORTABLE TAR MELTING KETTLE ASSEMBLY

BACKGROUND OF THE INVENTION

This invention relates to a portable tar melting kettle assembly, and is more particular directed to a kettle or pot and a melting stand for the kettle which permits rapid melting or softening of small amounts of asphalt, rubberized roofing tar or similar materials, using a commonly available driveway or roof torch as a flame source.

Tar is often employed for asphalt surfaces such as driveways, or for roofs, especially flat roofs. Workers often require small amounts, i.e., up to five gallons of melted or softened tar, for filling cracks or sealing joints in the asphalt surface.

Tar melting kettles now available are large and expensive pieces of equipment intended for melting large quantities of tar. These devices are not hand portable, and require a truck for towing them from place to place and a crane for lifting them to a roof for roofing work. Typical tar melting kettles are described in U.S. Pat. Nos. 4,033,328; 4,905,663; 4,781,171; 4,416,614; and 3,995,616.

For smaller quantities of liquid tar a worker typically melts chunks of tar in a five gallon bucket using open flame from a propane roofing torch or driveway torch. It requires about a half-hour to an hour to melt a quantity of tar with this method, and the worker has to devote his or her complete attention to the task. Also, the use of open flame poses safety risks.

The roofing and paving trades have long sought, without success, a technique for more rapid and more efficient melting of tar or similar products.

OBJECTS AND SUMMARY OF THE INVENTION

It is an object of this invention to provide a pot or kettle for melting roofing tar, paving tar or similar substances, which is portable, safe and simple to use, and which avoids the drawbacks of the prior art.

It is another object to provide a tar melting assembly which permits rapid melting of the tar.

It is a further object to provide a technique for melting tar which makes more efficient use of the workers time.

According to an aspect of this invention a tar melting assembly involves in combination a tar melting pot or kettle and a stand or tray. A commonly available propane fueled roofing torch or paving torch is coupled to the stand to melt the tar in the kettle. The tar kettle includes body which is formed of a front, a back, sides, and a bottom, with a pouring spout extending from the front. There a number of heat-exchanger tubes within the body adjacent the bottom, which extend between respective openings in the front and openings in the back. A handle permits lifting the kettle or tipping it to pour the molten tar out of the spout into a bucket or other receptacle. The stand has a tray formed of a front wall, a back wall, and sides which define a tray interior. The tray is open at the top forming a receptacle for the base of the kettle, such that the openings of the heat exchanger tubes are within the interior of the tray. These are also legs at each corner of the tray to elevate the kettle for melting tar, and a step plate affixed to the rear legs. This feature allows the worker to step on the plate to stabilize the tray when pouring out the melted tar.

A socket on the back wall of the stand tray is dimensioned to fit the head a propane torch, and releasably lock it in place. The socket opens to the interior of the tray. This brings the flame from the torch into the heat exchanger tubes of the kettle. The combustion gases pass through these tubes, and then exhaust around the body of the kettle, heating the tar quickly and evenly.

A five gallon load of solid tar, in the form of broken chunks, can be melted in about fifteen minutes, and because the torch is locked into the socket, the worker can attend to other tasks while the tar is melting.

After the tar has softened sufficiently, the torch is shut off and the tar is poured into a bucket for use in repairing cracks or sealing edges, in the usual fashion.

Preferably, the melting pot or kettle is formed of heavy gauge steel and can be carried by hand around the job site. Hard "tac" or flat roof tar, for example, is chipped off and placed into the kettle. The propane driveway or roof torch creates the heat for its operation. In about fifteen minutes the full load of hard tac chunks is heated to the boiling point. Then the hot liquid tar can be poured into a five-gallon bucket for distribution. The kettle design allows the operator to heat the tac and easily pour the hot liquid. Safety features include dual doors on the top of the kettle to reduce the heat around the handles and to serve as a splash guard so that the hot liquid tar does not splatter the operator. A safety latch torch lock on the socket prevents the propane torch head from disengaging while in use. The safety latch can have a T handle arranged on the bottom side of the socket so that the handle remains cool.

Another important safety feature is the step plate located on the rear legs of the stand. The step plate allows the operator to steady the stand, from either side or from the rear, to prevent the stand from tipping when hot liquid tar is being poured. At the front wall of the kettle a steel flange is attached above the heat exchanger tube openings to serve as a hinge point to stabilize the kettle during pouring.

This assembly has several advantages over existing techniques, including containing the torch flame during heating and permitting the operator to perform other tasks while the tar is heating. Also, the assembly is relatively inexpensive, but is quite rugged. The tar melts rather quickly, i.e., in fifteen minutes or less, which permits a patch or repair job to be carried out in minimum time.

The above and many other objects, features, and advantages of this invention will become apparent from the ensuing description of a preferred embodiment, to be read in conjunction with the accompany Drawing.

DETAILED DESCRIPTION OF THE PREFERRED EMBODIMENT

Figure 1:
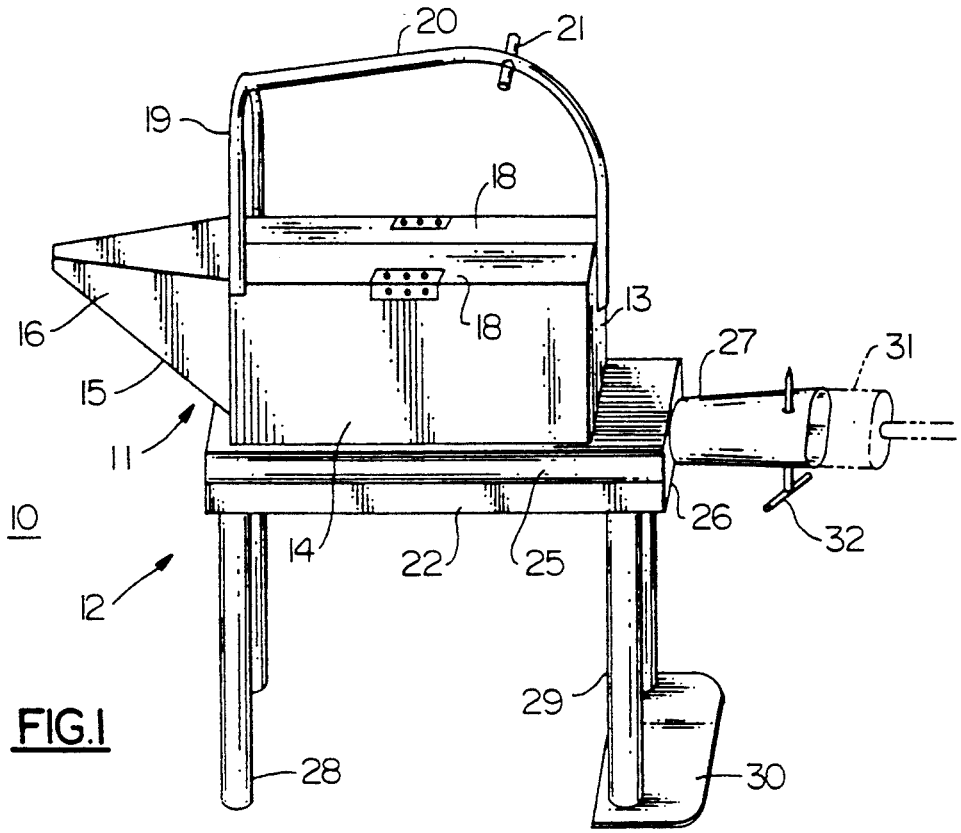
FIG. 1 is a perspective view of a tar melting assembly according to one preferred embodiment of this invention.
Figure 2:
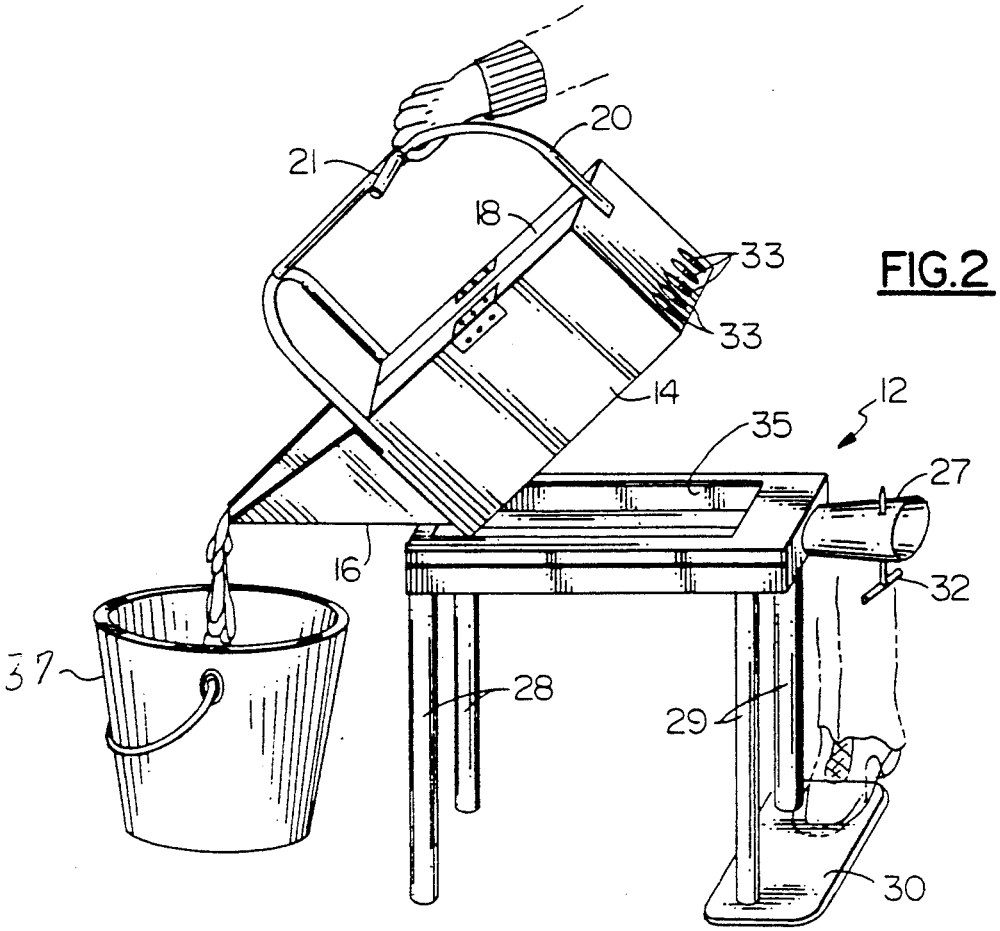
FIG. 2 is a perspective view showing the pouring of melted tar.

With reference to the Drawing, and initially to FIGS. 1 and 2, a tar melting assembly 10 comprises a pot or kettle 11 and a stand or base 12 for the kettle 11. The kettle has a body portion that is comprised of a back wall 13, a pair of side walls 14, and a front wall 15 from which a spout 16 emanates. A bottom 17, shown also in FIGS. 6 and 7 closes off the body portion of the kettle 11. At the top of the kettle 11 are a pair of hinged doors 18, which open and close from the side. These open to permit loading of chunks of solid tar into the kettle, and then close during the melting operation so that the operator is protected from heat, fumes, and splatter from the liquid tar.

A handle is formed of a front loop 19 and a top loop 20 which extends from the center of the top loop to the back wall 13. A T-handle 21 extends across the top loop 20 in this embodiment.

The stand is comprised of an upper tray portion 22 formed of a back wall 23, a bottom 24, a pair of sides 25, 25, and a front wall 26. In this embodiment the sides 25 are semicylindrical. A socket 27 extends out from the back wall. A pair of front legs 28 extend downward from the front corners and a pair of rear legs 29 extend downwards from the rear corners of the tray portion 22. A foot plate 30 is welded to the feet of the rear legs 29. In other versions, each leg 29 can have a separate step plate. A torch head 31, here shown in ghost, which comprises the front part of a driveway torch or roofing torch, is inserted into the socket 27, and is removably locked in place by a T-handle latching mechanism 32.

Figure 6:
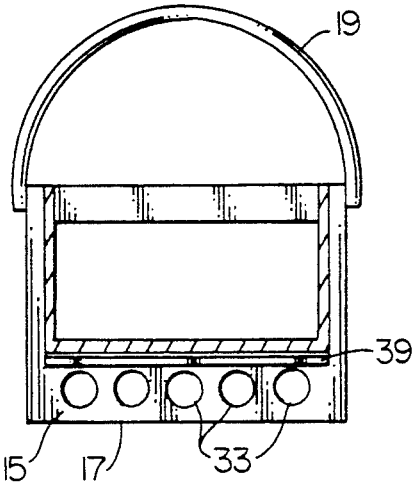
FIG. 6 and 7 are a sectional elevation and a sectional plan view taken respectively at 6—6 and 7—7 of FIG. 5.
Figure 4:
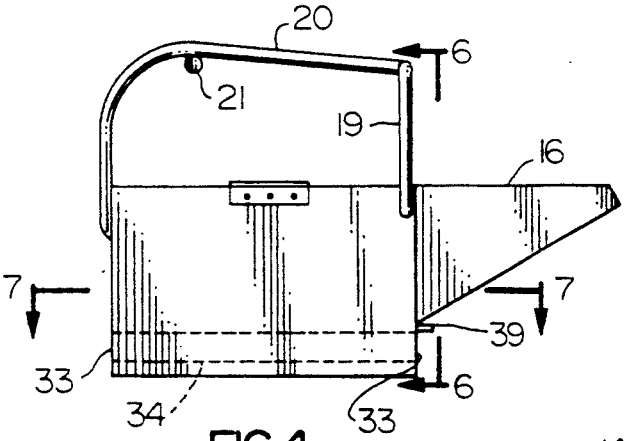
FIG. 4 is a perspective view of the melting kettle of this embodiment.
Figure 5:
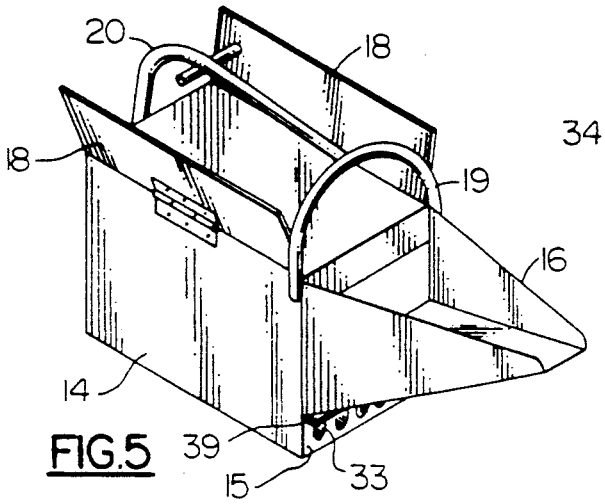
FIG. 5 is a side elevation of the melting kettle.
Figure 7:
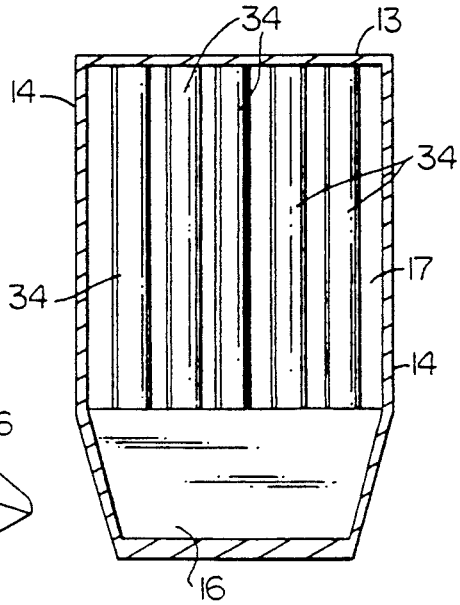

The kettle 11 has five openings 33 (see FIG. 2) which lead to respective heat exchanger tubes 34, shown in FIGS. 5, 6 and 7, which extend between the front and back walls of the kettle 11 adjacent to the bottom wall 17. These heat exchanger tubes 34 open onto similar openings 33 in the front wall 15, as shown in FIG. 4.

Figure 3:
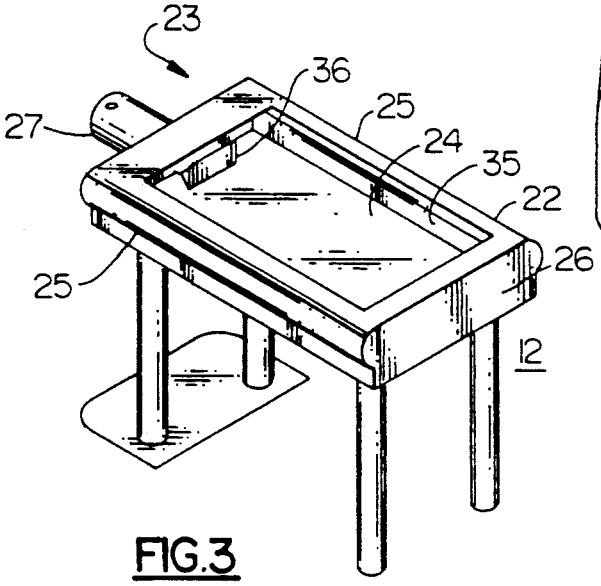
FIG. 3 is a perspective view of the stand of this embodiment.

The kettle 11 here has a rectangular footprint, and fits into a rectangular opening 35 on the top of the tray 22. The bottom, sides, front, and back walls of the tray define an interior space and the openings 33 of heat exchanger tubes 34 fit into this interior space below the top of the tray 22. Shown in FIG. 3, a baffle 36 can be provided near the socket opening within the tray to help distribute the flame evenly to the five heat exchanger tubes 34 of the kettle.

To use this system, the kettle top doors 18 are opened to the position shown in FIG. 5, and the chips or chunks of solid tar are loaded into the kettle 11. Then, the kettle is positioned on the stand, as shown in FIG. 1, and with the doors 18 closed, flame is applied through the torch head into the socket 27 and then into the interior of the tray 22. The torch flame enters into the heat exchanger tubes 34, so that the heat from the torch is in intimate contact with the tar. The flame enters through the openings 33 in the rear wall and exits out through the openings 33 in the front wall 15 of the kettle. Then the heat exhausts up around the sides of the kettle 11. This provides for even yet very rapid heating of the tar material, so that a five gallon load of tar in this device will melt in about fifteen minutes. Faster melting is possible in the case of pourable asphalt material, which is often available in pails or buckets.

After the material has been heated sufficiently to melt or soften it to the desired consistency, the operator shuts off the torch flame, and then, while standing on the foot plate 30, and with a gloved hand on the T-handle 21, simply pours the liquid tar into the molten tar out into a bucket 37 that is situated below the spout 16.

Figure 8:
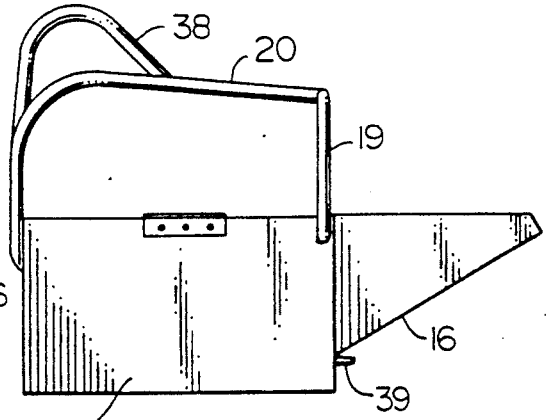
FIG. 8 is a perspective view of a melting kettle according to another embodiment of this invention.

An alternative configuration for the kettle is shown in FIG. 8, which is similar to the kettle of FIG. 1, except that a loop handle 38 is attached to the upper loop 20 in place of the T-handle 21. This shape handle facilitates pouring of pourable materials into the kettle for melting.

In either case, a steel flange 39 can be employed on the front wall 15 above the heat exchanger openings 33 to serve as a hinge point for stability of the kettle 11 when pouring.

While the invention has been described in detail with respective to a preferred embodiment, it should be understood that the invention is not limited to that precise embodiment; rather, many modifications and variations would become apparent to those skilled in the art without departing from the scope and spirit of this invention, as defined in the appended claims:

What is claimed is:

1. A tar melting assembly for use with a portable heat torch comprising a tar kettle that includes a body having a front, a back, sides, and a spout that extends from the front of the body; a plurality of heat exchanger tubes within the body adjacent said bottom and each of which has an opening through said front and an opening through said back; and means for tipping the kettle to pour melted tar out from said spout; and also comprising a stand for the tar kettle that includes a bottom, a front wall, a back wall and sides that define an interior of the stand, with an upper opening into which said tar kettle is seated so that the openings of the heat exchanger tubes are within the interior of the stand, and a torch receptacle for receiving a torch head for injecting flame into the interior of said stand such the flame enters said heat exchanger tubes for rapid melting of tar in said tar kettle.

2. The tar melting assembly of claim 1 wherein said torch receptacle includes a socket member attached onto said back wall of the stand and open through an opening in said back wall, into which the torch head is inserted.

3. The tar melting assembly of claim 2 said torch receptacle including means for releasably retaining the torch head in said socket member.

4. The tar melting assembly of claim 1 including one or more doors for closing over said tar during melting to retain heat in the kettle and operable for loading tar into the kettle for melting.

5. The tar melting assembly of claim 1 wherein said stand includes legs for elevating said kettle during melting.

6. The tar melting assembly of claim 5 wherein said stand includes a foot plate affixed onto a rear one of said legs on which an operator can step to stabilize the assembly for pouring the melted tar from said kettle.

7. The tar melting assembly of claim 1 wherein the side walls of said stand are semi-cylindrical.

* * * * *